US005713187A

United States Patent [19]

Peterson

[11] Patent Number: 5,713,187

[45] Date of Patent: Feb. 3, 1998

[54] PACKAGING APPARATUS

[76] Inventor: Guy Peterson, 181 Dunbar Way, Mahtomedi, Minn. 55145

[21] Appl. No.: 704,373

[22] Filed: Aug. 28, 1996

[51] Int. Cl.[6] ..... B65B 43/28; B65B 43/30

[52] U.S. Cl. ..... 53/566; 221/202; 221/211; 271/134; 493/316; 493/317

[58] Field of Search ..... 53/566, 381.1; 271/134, 102, 106; 221/87, 183, 176, 202, 211; 493/316, 317

[56] References Cited

U.S. PATENT DOCUMENTS

| | | | |
|---|---|---|---|
| 2,631,851 | 3/1953 | Jones . | |
| 2,732,206 | 1/1956 | Dietrich . | |
| 2,827,838 | 3/1958 | Pearson et al. . | |
| 3,015,923 | 1/1962 | Dotzenroth | 53/381.1 X |
| 3,334,890 | 8/1967 | Bombard . | |
| 3,420,037 | 1/1969 | Villemure et al. | 53/566 |
| 3,545,741 | 12/1970 | Porth . | |
| 3,713,651 | 1/1973 | Alber et al. . | |
| 3,858,490 | 1/1975 | Heisler | 493/316 |
| 3,991,660 | 11/1976 | Calvert et al. | 493/316 |
| 4,012,887 | 3/1977 | Calvert et al. | 53/566 X |
| 4,066,009 | 1/1978 | Calvert et al. | 493/316 |
| 4,081,945 | 4/1978 | Calvert et al. | 53/381.1 X |
| 4,674,736 | 6/1987 | Tsubo . | |
| 5,116,303 | 5/1992 | Dietrich et al. | 493/316 X |
| 5,127,894 | 7/1992 | Maccaferri | 53/566 X |

OTHER PUBLICATIONS

Mead Corporation, "MeadPackaging–Service Manual," 1988, pp. 1–1,2–2 to 2–8, and Figure.

*Primary Examiner*—Horace M. Culver

*Attorney, Agent, or Firm*—Palmatier, Sjoquist, Helget & Voigt, P.A.

[57] ABSTRACT

A boxing apparatus having a substantially horizontal conveyor feeds overlapping folded boxes into a upright gravity fed hopper with a bottom gate portion. The boxes are generally aligned axially in the hopper on the gate portion to be individually removed by a suction gripper positioned below the gate portion and which reciprocatingly moves up and down to grab and pull the bottommost folded box in the hopper through the gate portion. The box is opened and articles are fed into said box and said box is closed. The suction gripper having a reciprocating arm which reciprocates up and down to accomplish the reciprocating motion of the suction gripper. A tamper device comprised of a elongate member having a reciprocating stack tamper linked to the reciprocating arm and positioned such that the engagement portion of the tamper device follows the reciprocating motion of the reciprocating arm and translates said motion to the tamper for jogging the stack into alignment preventing hopper jams.

17 Claims, 4 Drawing Sheets

PACKAGING APPARATUS

BACKGROUND OF THE INVENTION

This invention relates to boxing equipment more particularly to equipment which unfolds and packs folded box flats.

Boxing apparatus receive folded boxes and packing products such as cans. The apparatus open, pack, and seal said boxes with the products and convey the boxes for further shipping or processing. Such packing apparatus are used in industries such as the brewing industry for packing "twelve packs" or larger boxes of beer cans. The boxing apparatus typically require the boxes to be fed by way of an intermittently operated conveyor into a hopper for providing the boxes in a stacked position for the equipment to open, pack, and seal said boxes. The proper operation of the equipment requires that the stack of boxes in the hopper is in substantial alignment.

The boxes as furnished to be packed in folded form have surface printing and other treatment and have glued portions. These characteristics can cause the folded boxes to stick to one another, not feather smoothly on the conveyor and become misaligned in the hopper. When this happens the boxes are not properly fed into the equipment thus causing jams, equipment stoppages, and possibly damaged product.

A conventional boxing apparatus as such is illustrated by the Model 1225-HM-B Duodozen machine manufactured by the Mead Corporation.

SUMMARY OF THE INVENTION

A boxing apparatus having a substantially horizontal conveyor feeds overlapping folded boxes into a upright gravity fed hopper with a bottom gate portion. The boxes are stacked in the hopper on the gate portion to be individually removed by a suction gripper positioned below the gate portion and which reciprocatingly moves up and down to grab and pull the bottommost folded box in the hopper through the gate portion. The box is opened and articles are fed into said box and said box is closed. The suction gripper having a reciprocating arm. A tamper device comprised of a elongate member having a reciprocating stack tamper is engaged with the reciprocating arm and positioned such that the engagement portion of the tamper device follows the reciprocating motion of the reciprocating arm and translates said motion to the tamper for jogging the stack into alignment.

An advantage of the invention is that the tamper apparatus prevents hopper jams and thus equipment down time.

An advantage of the invention is that the tamper motion may be coordinated with the box pull down such that the tamping occurs at an optimal time, such as when the stack is shifting downward or just prior to removal of the bottommost folded box, of the stack of boxes once with each pull down of the box.

A further advantage of a preferred embodiment of the invention is that the power and motion to operate the tamper device is conveniently derived from other moving mechanisms on the equipment. Thus no separate power source connections such as electrical wiring, pneumatic lines, or hydraulic lines are needed. Moreover, use of the existing moving mechanism eliminates the need for ancillary sensors, timers, and control circuitry for actuating the tampers.

A further advantage of the invention is that the tamper device may be simply constructed and is easily retrofitted on existing boxing equipment.

DETAILED DESCRIPTION OF THE PREFERRED EMBODIMENTS

Figure 1:
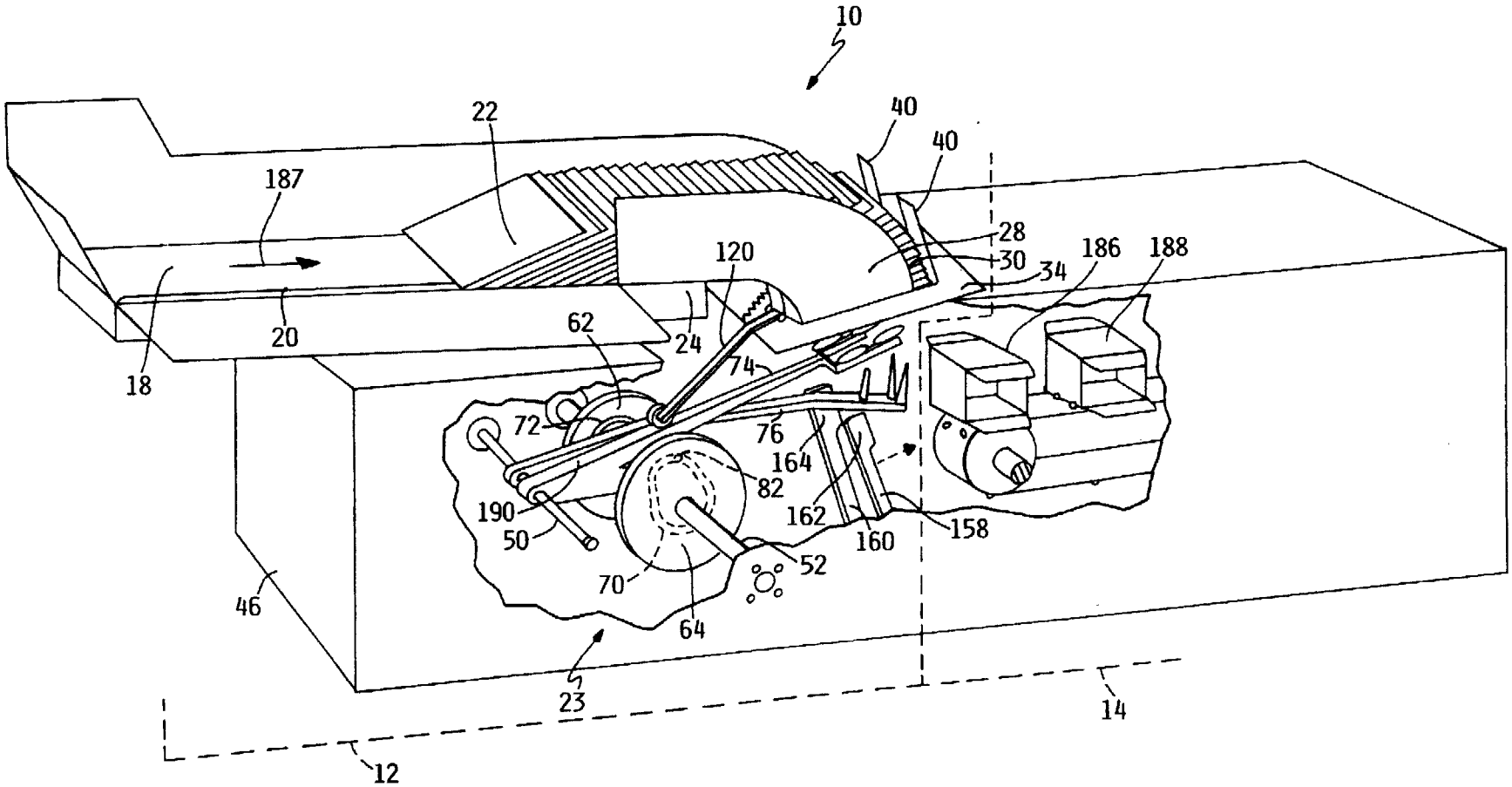
FIG. 1 is a perspective view of a packaging equipment with a portion cut-away, the box retracting an opening mechanism and the second conveyor.
Figure 2:
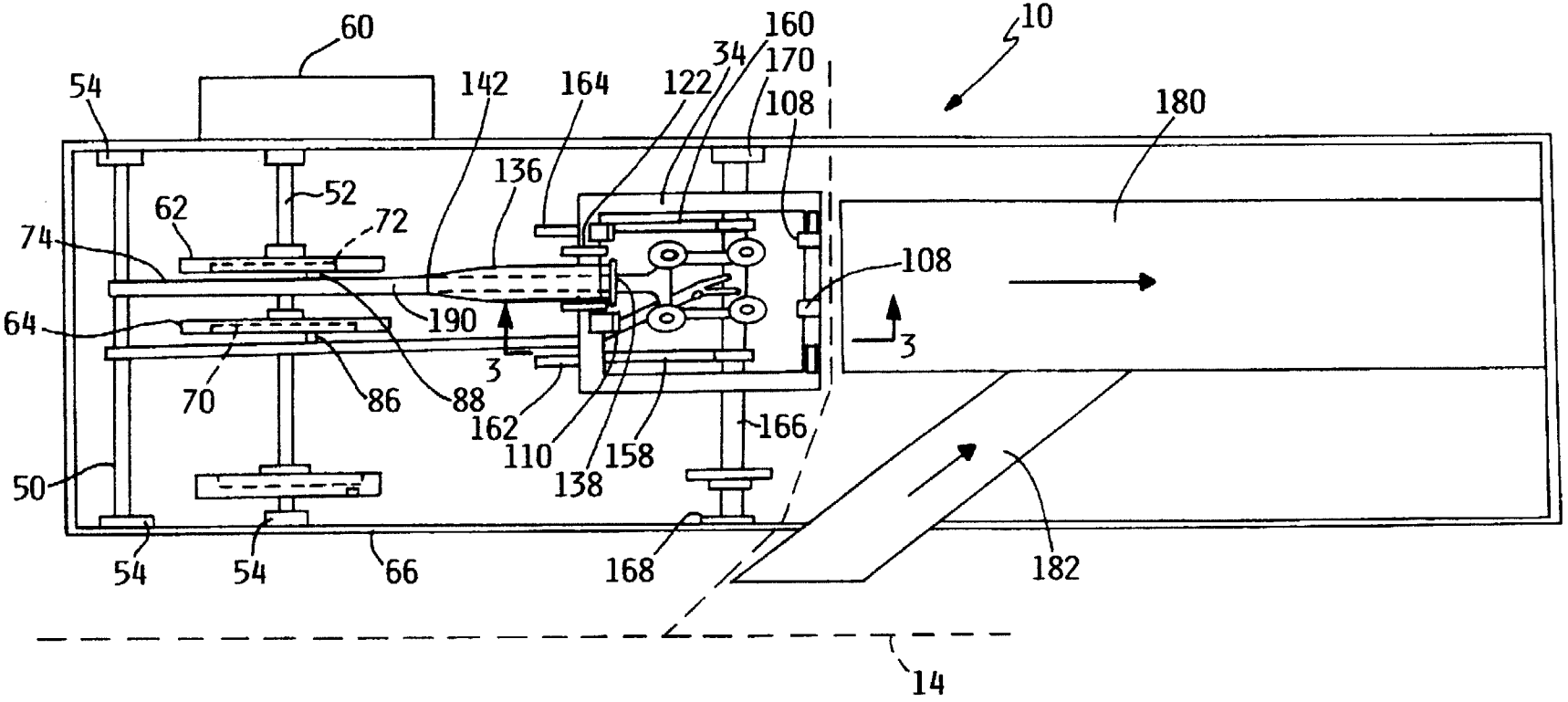
FIG. 2 is a plan view of the boxing apparatus with the first conveyor and top removed.
Figure 3:
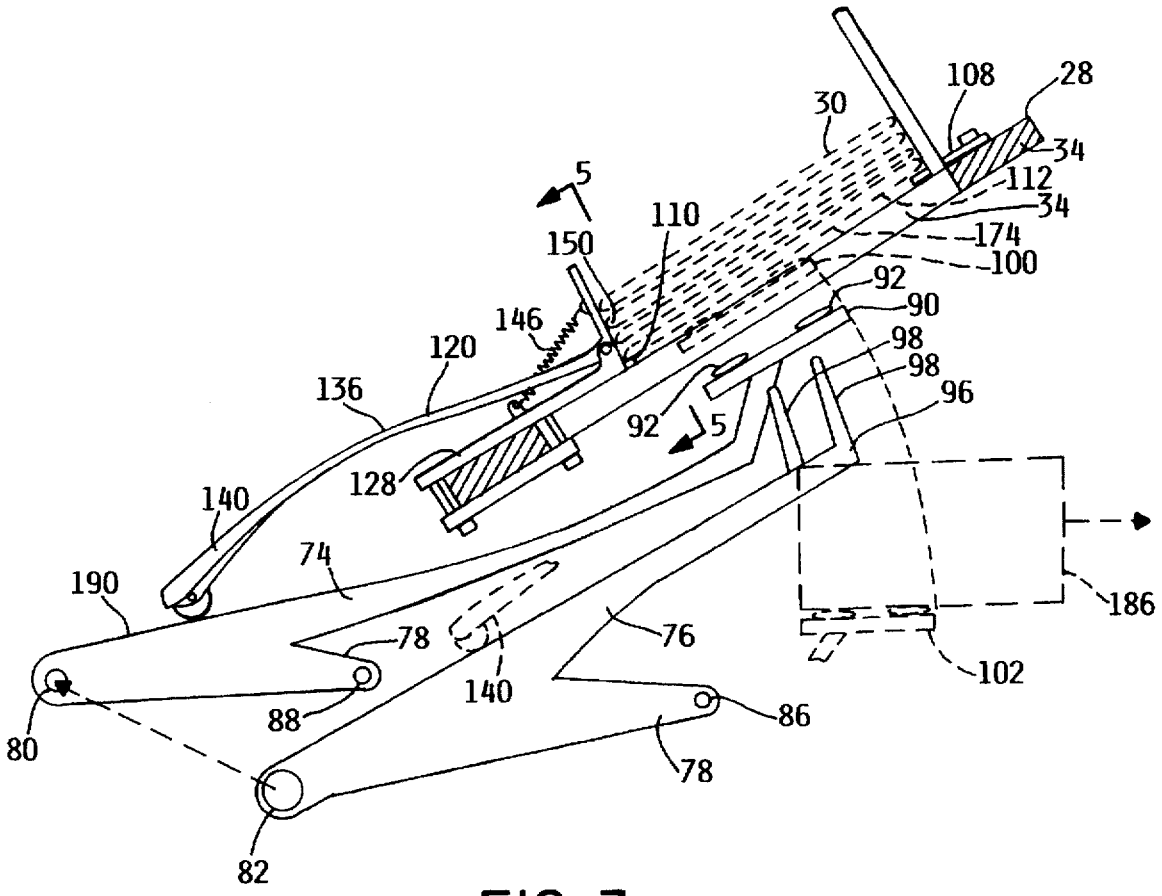
FIG. 3 is a side elevational view and partial sectional of the hopper bottom gate portion and with the attached tamper device. The box erector arm is offset to fully disclose the grasping arm.

Referring to FIGS. 1 and 2 a boxing apparatus generally designated with the numeral 10 is shown. The apparatus generally comprised of a box feed portion 12 and a packing portion 14. The box feed portion is comprised of a first conveyor 18 which is generally situated horizontally with an open receiving area 20 for receiving folded boxes 22, and a box retrieval and opening portion 23. The first conveyor 18 has a discharge end 24 which feeds into a hopper 28. The conveyance of the folded boxes 22 into the hopper loads them in a upright stack 30. The hopper 28 has a bottom gate portion 34 and guides 40 for assisting in aligning the stack 30 of folded boxes 22.

The boxing apparatus 10 generally has a frame 46 which supports the first conveyor 18 and the other mechanisms associated with the boxing apparatus. For example, the box feed portion 12 includes an axle 50 and a cam shaft 52 which are both secured to the frame 46 by way of bearing blocks 54. The cam shaft 52 rotates by way of a drive 60. The cam shaft 52 includes several cammed wheels 62, 64, 66. Each of the cam wheels have cammed portions 70, 72. Operating off the pair of cammed wheels 62, 64 are reciprocating members, specifically a grasping arm 74 and a box erector arm 76. The grasping arm and box erector arm are pivotally attached to the pivoting axle 50 at connecting portions 80 and 82 and are engaged with the cam portions 70 of the cam wheels 62, 64 by way of the cam followers 86, 88. The grasping arm 74 has a grasping portion 90 which has a plurality of suction members 92 which are connected to a vacuum line (not shown) to allow the grasping portion to adhere to and grasp the boxes. The box erector arm 76 has a box engagement end 96 with erector fingers 98. Both the erector arm 76 and the grasping arm 74 reciprocate as they pivot about the pivoting shaft 50 with the grasping portion 90 of the grasping arm 74 reciprocating between an upper grasping position 100 and a lower release position 102 shown by way of dashed lines.

Figure 4:
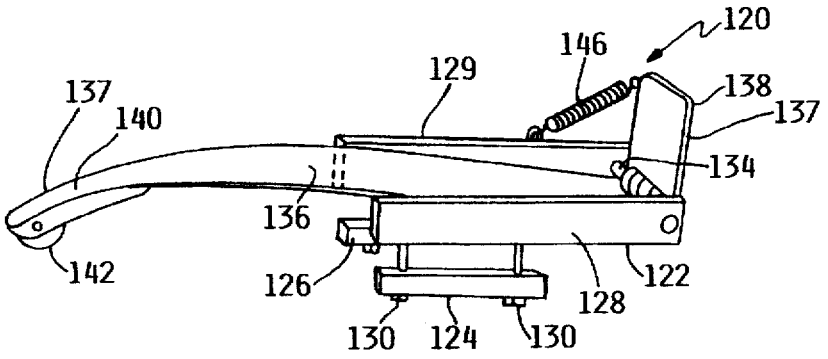
FIG. 4 is a perspective view of a tamper device suitable for addition to existing packaging equipment.

The hopper 28 is comprised of the rectangular gate portion 34 with retaining tabs 108, 110 which support the stack 30 of boxes by way of the bottommost box 112. Attached to the rectangular gate portion 34 is the tamper device 120 which is shown in isolation in FIG. 4. The tamper device has a support bracket 122 comprised of a clamping portions 124, 126 and base portions 128, 129. The clamping portions 124, 126 are adjustably connected to the base portion 128 by way of screws 130. Pivotally attached to the bracket 122 by way of a pin 134 is an arm portion 136 which has opposite ends 137 with a stack engagement portion or tamper portion 138 at one end and a follower portion 140 at the other end. The stack engagement portion 138 is fixed with respect to the arm portion 136. The follower portion includes, in this embodiment, a wheel 142 which engages and rides upon the grasping arm 74. Said wheel could also engage the box erector arm 76. A spring 146 attaches to the base portion 128 and the tamper portion 13 8 to provide a downward bias to the follower portion 140 to maintain engagement with the grasping arms 74. The stack engagement portion 138 is positioned to engage an open accessible side 150 of the stack 30 of boxes. The bracket 122 is clamped to the rectangular gate portion 34 and allows adjustment and positioning of the tamper portion.

The folded box feed portion further comprises a pair of feed paddles 158, 160 each with a box engagement head 162, 164. The feed paddles 158, 160 are affixed to the shaft 166 which is rotatably mounted to the frame 46 such as by bearing blocks 168, 170. The shaft 166 may be linked to the cam shaft 50 by suitable links or cranks (not shown) to drive the paddles and to provide a further reciprocating motion of the paddles 158, 160 to push the boxes forward when the grasping portion 90 of the grasping arm 74 is in the lower release position 102. The paddles and associated mechanisms are configured to be out of the way of the reciprocations of the grasping arm 74 and the box erector arm 76.

The packing portion 14 of the boxing apparatus 10 has a second horizontal conveyor 180 and can insertion portion 182 which is conventional and will not be shown in detail.

The invention operates as follows. Referring to the figures, boxes are placed in a feathered or layered manner as shown in the receiving area 20 on the first conveyor 18. The first conveyor is typically automatically actuated in accordance with the height of the stack 30 of boxes in the hopper 28 such as by electrical optical devices, not shown. The first conveyor thus operates intermittently. The feathered boxes are put into the stack portion by said horizontal movement of the conveyor as indicated by the arrow 18. The drive 60 is actuated causing rotation of the cam shaft 52 and thus the cammed wheels 62, 64. The cammed wheels have the cammed portions 70 which are engaged by the cam followers 86, 88 of the grasping arm 74 and box erector 76 respectively. As the cammed wheels 62, 64 rotate in the cam followers 86, 88 follow the cam surfaces the grasping arm 74 and erector arm 76 reciprocate upwardly and downwardly in a precisely sequenced and timed manner. The grasping portion 90 swings upwardly to engage the bottommost box 112 in the hopper 28. The suction members 92 adhere to the lower layer and outer surface 174 of the folded bottommost box and continue to adhere as the grasping arm reciprocates downwardly toward the lower release position 102. As the grasping arm 74 starts downwardly the box erector arm 76 substantially holds its position until the erector fingers 98 push through specified openings in the bottom surface of the bottommost box to engage the top panel of the box to assist in opening said box. Opening of the box is also facilitated by the retrieval thru the gate portion 34. The erector arm 76 will then move downwardly with the grasping arm 74 to the release position 102. At the release position 102 the box erector arm 76 and the erector fingers 98 are moved further downwardly so as to not to interfere with the release of the then unfolded box 186. The unfolded box is conveyed by way of the feed paddles 158, 160 into engagement with the second conveyor 180 where they are conveyed for filling and sealing. The process repeats to provide a steady stream of opened boxes 188. The operation of the packaging portion 14 and also operation of conventional boxing apparatus in general is illustrated by the manual for the Mead Duodozen 1225-HM-B packaging equipment available from the Mead packaging machinery division home office 999 Lee Street S.W., Atlanta, Ga. 30310.

Figure 6:
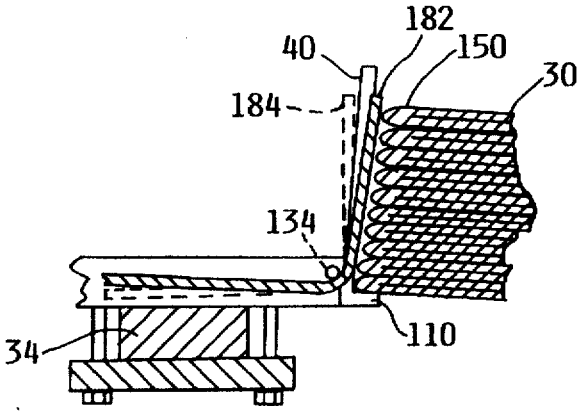
FIG. 6 is a partial sectional taken at line 6—6 of FIG. 5.

The reciprocating motion of the grasping arm 74 is utilized to assure proper substantial alignment of the stack of boxes in the hopper for reliable and continuous feeding of boxes through the gate portion and into the packaging portion. FIG. 6 illustrates a pivoting reciprocation with the tamper portion reciprocating between the stack engagement position 182 and the retracted position 184. The reciprocation is provided by way of the tamper device 120 with the wheel 142 on the follower portion 140 engaged with the top surface 190 of the grasping arm 74. The arm portion 136 and tamper portion 138 of the tamper device pivots about the pin 134 thus providing a corresponding reciprocating motion to the tamper portion 138 which engages the accessible side 150 of the stack 30. The apparatus may operate at relatively high speeds with the reciprocations at relatively high frequencies. The spring 146 assists the follower portion 140 to maintain the contact with the grasping arm 74 at such frequencies.

The tamper device need not operate by way of a follower portion 140 and may be linked directly to a reciprocating arm or may otherwise be linked or connected to any of the reciprocating members or other moving parts of the feed portion 12 or other portions of the packaging equipment.

Figure 5:
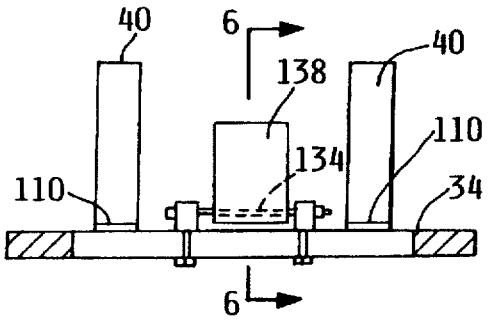
FIG. 5 is a partial sectional taken at line 5—5 of FIG. 3.
Figure 7:
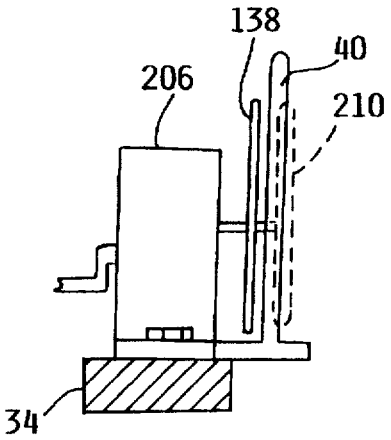
FIG. 7 is a partial sectional of the same view as FIG. 6 showing an alternate configuration of a tamping device.
Figure 7A:
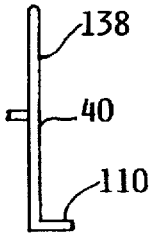
FIG. 7A is an elevational view of an alternate tampering portion.

FIG. 7 shows an alternate configuration of the tamper device in which a motor 206 drives the tamper portion. The motor 206 may be suitably attached to the gate portion 34 or elsewhere on the apparatus. The motor is externally powered such as pneumatically, electrically, mechanically or hydraulically to provide a reciprocating motion to the tamper portion 138 as illustrated by the tamping position shown by the dashed lines with the numeral 210. The motor 206 may work in conjunction with sensor and/or control means, not shown, to time and coordinate the reciprocating motion. FIG. 7*a* discloses an alternate tamper portion in which a tab for supporting the stack of boxes is attached to the tamper portion. The tab 110 on the tamper portion 138 may be used with the configuration as shown in FIG. 5 or in conjunction with a motor driven tamper portion 138 such as shown in FIG. 7. The tamper portion 138 may suitably also operate as a hopper guide 40. Particularly where the tamper portion 138 functions as a guide 40, the reciprocation of the tamper portion 138 may consist of a vibration rather than a series of distinct contacts with the side 150 of the stack 30.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

I claim:

1. A boxing apparatus for opening and packing folded boxes, the apparatus comprised of a folded box feed portion and a packing portion, the folded box feed portion comprised of:

a first conveyor for conveying overlapping folded boxes, the conveyer having a discharge end;

an upright gravity fed hopper with a bottom gate portion, the hopper positioned at the discharge end of the conveyor to receive the folded boxes in a stack, the stack having a bottommost box, the gate portion positioned to support said stack of folded boxes by the bottommost folded box;

a grasping arm, the grasping arm having a grasping portion for grasping the bottommost box in the stack, the grasping arm powered and positioned to reciprocate thereby moving the grasping portion between a grasping position at the gate portion and a release position proximate to the packing portion of the apparatus, thereby providing a stream of boxes for the packing portion; and a tamper device having an arm portion, a follower portion connected to the arm portion, and a stack engagement portion for jogging the stack, the stack engagement portion also attached to the arm portion, the follower portion positioned to at least partially follow the reciprocating grasping arm, the arm portion configured such that as the grasping arm reciprocates, the stack engagement portion engages the side of the stack whereby the folded boxes are urged into alignment in said hopper.

2. The apparatus of claim 1 wherein the arm portion of the tamper device is elongate with two ends, and whereby the follower portion is on one end of said arm portion and the stack engagement portion is on the other end.

3. The apparatus of claim 2 wherein the follower portion is comprised of a wheel engaged with the grasping arm.

4. The apparatus of claim 1 wherein the grasping arm has a grasping portion comprised of at least one suction member with a negative pressure for adhering to and grasping the bottommost folded box from the stack.

5. The apparatus of claim 1 the packing portion comprises a second conveyor, and the feed portion further comprises a feed paddle powered and positioned such that the paddle pushes boxes which are grasped by the grasping portion of the grasping arm in the release position onto said conveyor.

6. The apparatus of claim 1 wherein the grasping arm is pivotally connected to the frame and wherein the grasping portion reciprocates between an upward grasping position whereby the grasping portion is in contact with the bottommost folded box on the stack, and a lower release position.

7. The apparatus of claim 1 wherein the grasping arm has a cam follower and wherein the apparatus is further comprised of a rotating cam shaft connected to the frame, the cam shaft having with a cam surface engaged with said cam follower whereby the reciprocation motion is provided to the tamper device by said cam follower engaged with said cam surface.

8. The apparatus of claim 1 wherein the tamper device is clamped to the gate portion.

9. A boxing apparatus for opening folded boxes and filling same, the apparatus comprised of a folded box feed portion and a packing portion, the folded box feed portion comprised of:

a first conveyor for conveying folded boxes feathered on the conveyor, the conveyer having a discharge end;

an upright hopper with a bottom gate portion, the hopper positioned at the discharge end of the conveyor to receive the folded boxes in a stack in said hopper, the stack having a bottommost box and a stack side, the bottommost box adjacent the gate portion;

a tamper device positioned at the hopper, the tamper device having a stack engagement portion confronting the stack side, the tamper device powered to move inwardly and outwardly with respect to the stack thereby urging the stack into an alignment position in the hopper; and a retrieving and opening portion of the apparatus for advancing and opening the bottommost box in the stack to the packing portion of the apparatus.

10. The apparatus of claim 9 wherein the retrieving and opening portion of the apparatus comprises a reciprocating arm portion and the tamper device comprises an arm portion engaged with the reciprocating arm portion for powering the tamping device.

11. The apparatus of claim 10 wherein the retrieving and opening portion comprises a rotating cam shaft with a cam surface, wherein the reciprocating arm has a grasping portion and a cam follower engaged with the cam surface, the grasping arm pivotally attached to the frame and configured such that when the cam shaft rotates the grasping portion reciprocates between a grasping position at the bottom gate portion and a release position, the arm portion of the tamper device having a follower portion engaged with the reciprocating arm portion.

12. The apparatus of claim 9 wherein the box feed portion comprises a rotating cam shaft with a first cam surface and a grasping arm, the grasping arm having a grasping portion and a first cam follower engaged with the first cam surface, the grasping arm pivotally attached to the frame and configured such that when the cam shaft rotates the grasping portion and reciprocates between a grasping position at the bottom gate portion and a release position at the packing portion of the apparatus, the grasping arm pivotally attached to the frame and configured such that when the cam shaft rotates, the tamper device having a follower portion and a pivot point, the follower portion following the grasping arm whereby the tamping device is provided a reciprocating motion.

13. The apparatus of claim 9 wherein the box feed portion comprises a rotating cam shaft with a cam surface and a box erector arm, the box erector arm having a cam follower engaged with the cam surface, the erector arm pivotally attached to the frame and configured such that when the cam shaft rotates the erector are reciprocates into a position adjacent to the bottom gate portion, the tamper device having a follower portion attached to the frame, a pivot point attached to the frame, and a follower portion the follower portion contacting the box opening arm, whereby the tamping device is provided a reciprocating motion.

14. The apparatus of claim 9 where in the tamper device is comprised of a motor to provide a reciprocating motion to the stack engagement portion.

15. A boxing apparatus comprising:

a hopper for holding a substantially upright stack of folded boxes including a bottommost box;

a box retrieval and opening portion positioned below said hopper for retrieving and opening the bottommost box in the upright stack, said retrieval and opening portion including a reciprocating member, said retrieving and opening portion requiring a stack of boxes with substantial alignment; and a stack engagement portion to engage the upright stack, said stack engagement portion mechanically linked to the reciprocating member for providing a reciprocating motion for urging said stack into substantial alignment.

16. The apparatus of claim 15, wherein the hopper comprises a gate portion for supporting the bottommost box and the stack engagement portion is positioned adjacent to said gate portion.

17. The apparatus of claim 15 wherein the stack engagement portion pivots about a pivot point adjacent to the gate portion.

* * * * *